United States Patent [19]

Morishita

[11] 4,079,646

[45] Mar. 21, 1978

[54] RECORD MATERIAL CUTTING MECHANISM

[75] Inventor: Keisuke Morishita, Hiyatsuka, Japan

[73] Assignee: NCR Corporation, Dayton, Ohio

[21] Appl. No.: 791,815

[22] Filed: Apr. 28, 1977

[51] Int. Cl.[2] ..... B26D 1/38

[52] U.S. Cl. ..... 83/349; 83/553; 83/675; 83/695; 83/926 H

[58] Field of Search ..... 83/349, 508, 508.1, 83/553, 695, 678, 509, 561, 529, 343, 346, 926 H

[56] References Cited

U.S. PATENT DOCUMENTS

| | | | |
|---|---|---|---|
| 2,007,544 | 7/1935 | Meisel | 83/349 X |
| 3,522,753 | 8/1970 | Schmied | 83/561 X |
| 3,956,954 | 5/1976 | Edwards | 83/349 X |

*Primary Examiner*—Willie G. Abercrombie

*Attorney, Agent, or Firm*—J. T. Cavender; Wilbert Hawk, Jr.; Richard W. Lavin

[57] ABSTRACT

An apparatus for use in a data terminal device or other type of business machine for providing a plurality of different cutting configurations on a receipt or other type of record member. The apparatus includes a rotatably mounted stationary blade member having a plurality of different cutting edge configurations, a rotating blade member coacting with one of the cutting edges of the stationary blade member to cut the record member in accordance with the configuration of the cutting edge of the stationary blade member, and selectively operated activating means for rotating the stationary blade member to position one of the cutting edges thereof adjacent the record member so as to provide a predetermined cutting pattern on the record member upon operation of the rotating blade member.

23 Claims, 3 Drawing Figures

RECORD MATERIAL CUTTING MECHANISM

BACKGROUND OF THE INVENTION

In merchandising operations wherein a data terminal device or other type of accounting machine is utilized to calculate the amount due and paid, a copy of the sales transaction in the form of a printed receipt is given to the customer. Prior terminal devices have utilized a moveable knife member operating in a scissors-like fashion to cut the printed receipt for removal by the operator. In some instances, it is desirable that a portion of the receipt which is to be given to the customer can be detached for use in proof-of-purchase in case the item is to be returned. Therefore, it is desirable that a portion of the receipt be partially severed or perforated to facilitate its removal by the customer.

Prior attempts to provide such a receipt have resulted in use of a cutting mechanism having the capability of varying the depth of the cutting stroke of the knife blade. An example of this type of mechanism can be found in U.S. Pat. No. 3,850,068, and which is assigned to the assignee of the present application. While this type of cutting mechanism allows the receipt to be cut in varying depths, there are applications where it is more desirable to perforate that portion of the receipt which is to be removed rather than severing the receipt. In this latter instance, the perforating mechanism has been required to be manually inserted within the terminal device replacing the cutting mechanism which had been used for severing the receipt. This requirement of replacing the cutting mechanism to provide a particular cutting mode has increased the cost of the terminal device while detracting from its application in those cases where a plurality of cutting modes are intermittently required due to the time required to replace the cutting mechanism.

It is therefore a principal object of this invention to provide a single cutting mechanism capable of providing different cutting modes. It is another object of this invention to provide a cutting mechanism which can be remotely controlled to provide different cutting modes. It is a further object of this invention to provide a cutting mechanism capable of providing different cutting modes and which is sufficiently compact in construction so as to be conveniently mounted within a data terminal device or other type of business machine. It is still another object of this invention to provide such a cutting mechanism which is simple in its construction and therefore low in cost.

SUMMARY OF THE INVENTION

In order to carry out these objects, there is provided a cutting mechanism which includes a rotating blade support member having a cutting edge located thereon, a drive member for rotating said blade support member through a cycle of operation, a rotatably mounted polygonal shaped stationary blade support member having a plurality of cutting edges thereon, each cutting edge providing a different mode of cutting and cooperating with the cutting edge of the rotating blade support member to cut across a record member positioned between the cutting edges, and means for selectively rotating said stationary blade support member to position one of its cutting edges in registry with the rotating blade support member cutting edge.

DESCRIPTION OF THE PREFERRED INVENTION

Figure 1:
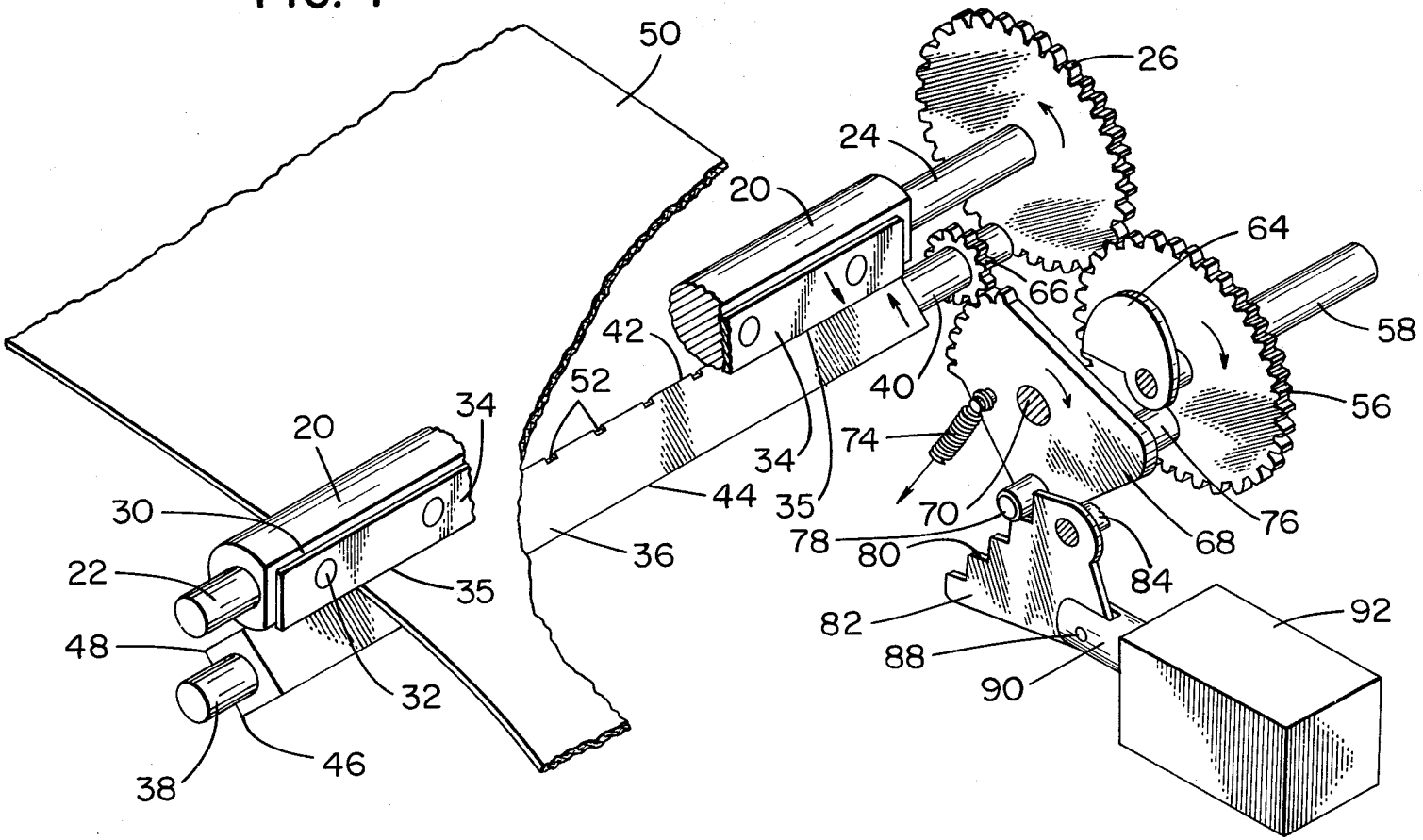
FIG. 1 is an oblique view of the multi-mode cutting mechanism with a portion of the rotating blade support member and the record member removed so as to show the configuration of two of the cutting edges of the stationary blade support member.

Referring now to FIG. 1, there is shown in perspective the multi-mode cutting mechanism which includes a rotary member 20 having shaft portions 22, 24 which are journaled within the framework (not shown) of the terminal device. Secured to the shaft portion 24 is a gear member 26 (see also FIG. 3) by means of a pin 28. The drum member 20 includes a flat surface 30 to which is secured, by any suitable fastening means such as rivets 32, a knife blade 34 having a cutting edge 35.

Associated with member 20 is a polygonal shaped support member 36 having shaft portions 38, 40 journaled within the framework (not shown) of the terminal device. The support member 36 of the present embodiment has four cutting edges 42, 44, 46 and 48 (FIGS. 1–3) which cooperate with the cutting edge 35 of the knife blade 34 to cut a record member 50 positioned between member 20 and the support member 36. As shown more clearly in FIG. 1, the cutting edge 42 of the support member 36 includes a plurality of spaced notches 52 causing the cutting edge 42 to perforate the record member 50 when located in a cutting position with respect to the knife blade 34. Cutting edge 44 (FIG. 1) is configured to cut transversely across the record member 50 when aligned for operation with the knife blade 34, thereby completely severing the record member. Edge 46 (FIG. 3) has a recessed portion 54 extending along a predetermined distance to provide a partial severing of the record member 50 when operated with the blade 34. And cutting edge 48 (FIG. 1) is also provided with a recessed portion (not shown) similar to portion 54 of edge 46 but extending a distance which is different from that of portion 54 to provide an extent of cut across the record member 50 different from that of edge 46.

Figure 2:
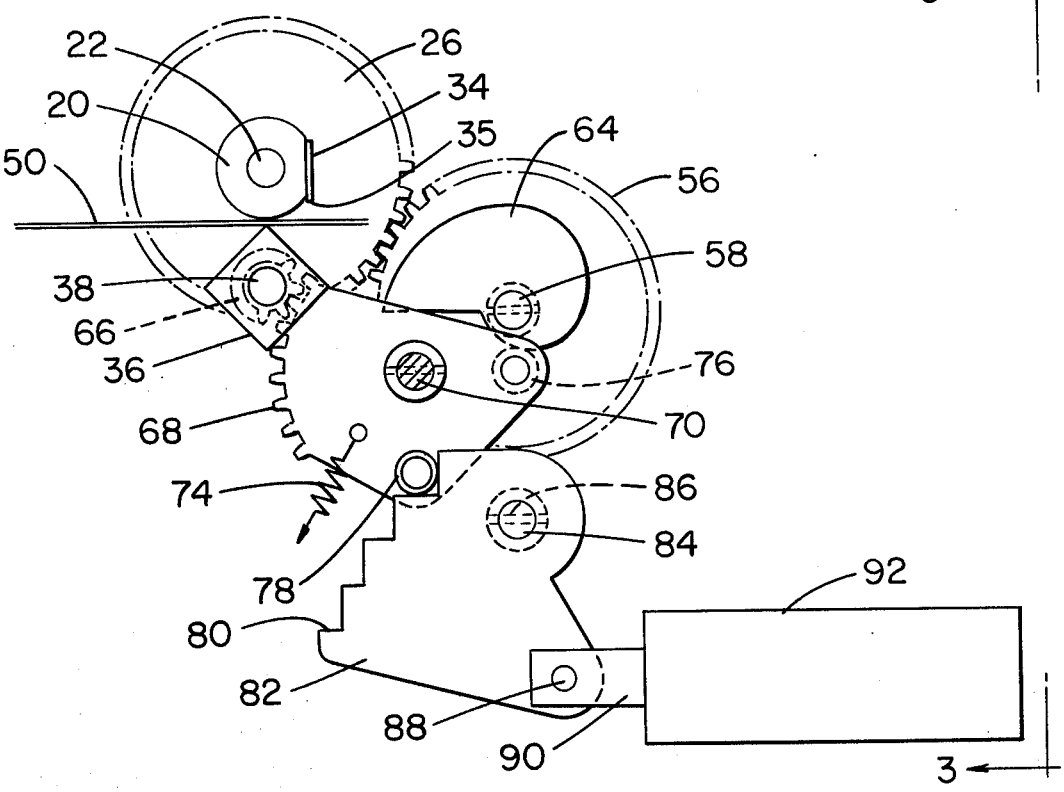
FIG. 2 is a side view of the multi-mode cutting mechanism.
Figure 3:
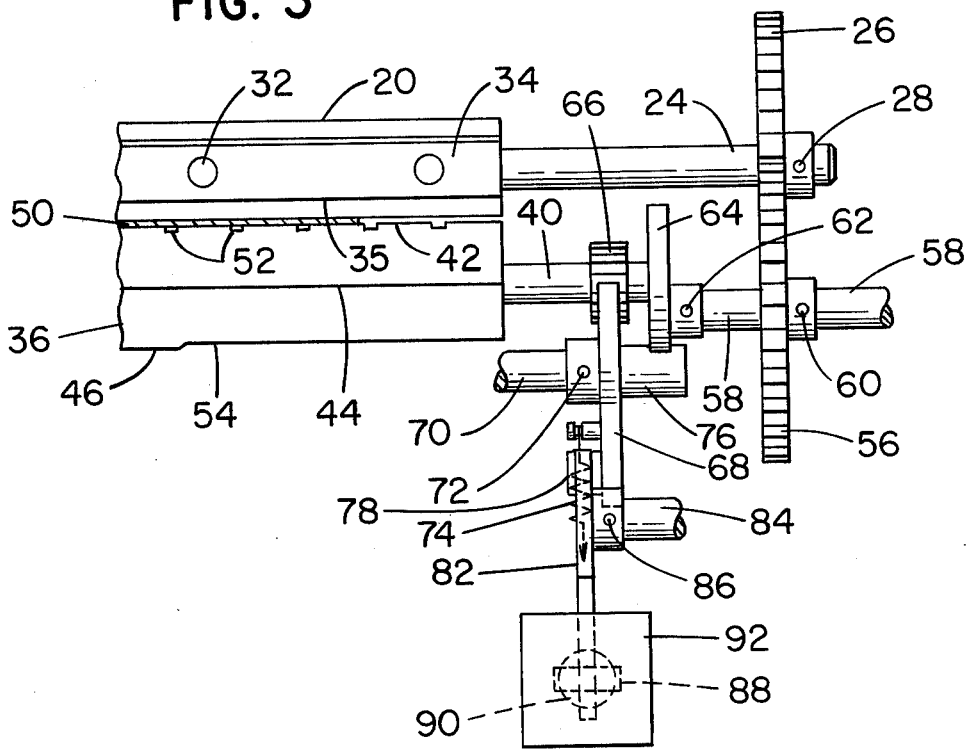
FIG. 3 is a view taken on lines 3—3 of FIG. 2 showing the configuration of three of the cutting edges of the stationary blade support member.

Located adjacent the gear 26 and intermeshed therewith is a driving gear 56 (FIGS. 1, 2 and 3) having the same diameter as gear member 26 and secured to a drive shaft 58 by means of pin 60 (FIG. 3). The end of the drive shaft 58 has secured thereto, by means of pin 62, a cam member 64. As will be described hereinafter, the cam member 64 is associated with a mechanism for selectively positioning one of the cutting edges 42–48 inclusive of the support member 36 in shearing alignment with the cutting edge 35 to cut the record member 50 upon rotation of the knife blade 34 past the selected cutting edge of the support member 36. The drive shaft 58 is driven through one clockwise revolution (FIG. 1) by a motor (not shown) secured to the drive shaft 58 during each operation of the cutting mechanism.

As clearly shown in FIGS. 1 and 3, secured to the shaft portion 40 of the support member 36 is a pinion gear 66 which is engaged by a gear segment 68 secured to a shaft 70 by means of a pin 72 (FIG. 3). The shaft 70 is journaled within the framework (not shown) of the terminal device. A spring 74 connected between the segment 68 and the framework (not shown) of the terminal device normally biases the segment 68 in a counter-clockwise direction with respect to the shaft 70.

Mounted to one side of the gear segment 68 is a cam roller 76 (FIGS. 1, 2 and 3) which extends horizontally to a position in operable alignment with the cam member 64. Mounted to the opposite lower side of the gear segment 68 is a stud 78 extending horizontally to a position adjacent to and normally engaging one of a plurality of stepped edge portions 80 of a control segment 82 secured to a shaft 84 by means of pin 86, the shaft 84 being journaled within the framework (not shown) of the terminal device. As will be described more fully hereinafter, each of the stepped edge portions 80 of the segment 82 controls the positioning of a corresponding one of the cutting edges 42–48 of the support member 36 in operable alignment with the knife blade 34. The lower rear portion of the control segment 82 is rotatably secured, by means of a pin member 88, to the armature 90 of a four position solenoid 92. Energizing of the solenoid 92 will thus rotate the control segment 82 about the shaft 84 to position one of the stepped edge portions 80 of the segment 82 in the path of movement of the stud 78 located on the gear segment 68. It will be seen from this arrangement that the length of the rotational movement of the gear segment 68 is determined by the adjusted position of the control segment 82 which in turn is controlled by the selective energizing of the solenoid 92. The energizing of the solenoid 92 may be controlled by activation of certain control keys on the keyboard of the terminal device, which control keys are used to initiate certain machine operations required to be performed in order to carry out the merchandising operation.

In the operation of the cutting mechanism, the drive shaft 58 will be rotated in a clockwise direction through one revolution by an associated drive motor (not shown). This rotation of shaft 58 is transmitted to drive gear 56 which in turn rotates the gear 26 in a counter-clockwise direction as shown by the arrow in FIG. 1. Rotation of shaft 58 also results in the clockwise rotation of the cam member 64, during which movement the gear segment 68 is first rocked in a clockwise direction about the shaft 70 as indicated by the arrow in FIG. 1, this latter rotation resulting from the engagement of the cam member 64 with the cam roller 76 and occurring against the action of the spring 74. The cam member 64 is shaped, as shown in FIG. 2, such that at approximately ¾ through its clockwise rotation, the cam member 64 will release the gear segment 68 to the action of the spring 74 resulting in the return rotation of the gear segment 68 in a counter-clockwise direction.

As understood from FIGS. 1 and 2, the clockwise rotation of the gear segment 68 by the cam member 64 will result in the moving of the stud 78 from engagement with the stepped portions 80 of the control segment 82. Upon removal of the stud 78 from the segment 82, solenoid 92 is energized to move its armature 90 to one of four operational positions, which movement rotates the control arm 82 to position one of the stepped portions 80 in the path of movement of the stud 78. The selected stepped portion 80 corresponds to the cutting edge of the support member 36 required for the particular receipt to be issued to the customer. Upon the counter-clockwise movement of the gear segment 68 by the action of the spring 74, the gear segment 68 will rotate a distance commensurate with the stepped portion 80 of the control segment 82 selected by the energizing of the solenoid 92 for positioning in the path of movement of the stud 78. This rotation of the gear segment 68 is transmitted through the pinion gear 66 to the support member 36 to position one of the cutting edges 42, 44, 46 or 48 with respect to the knife blade 34 in accordance with the stepped portion 80 of the control segment 82 engaged by the stud 76.

Simultaneous with the movement of one of the cutting edges 42–48 of the support member 36 to a cutting position, the counter-clockwise rotation of gear member 26 by the drive gear 56 will rotate the knife blade 34 until it engages the record member 50. By this time, the support member 36 has been rotated to position a selected one of its cutting edges 42–48 adjacent the record member 50 so as to co-act with the cutting edge 35 of the knife blade 34 to cut the record member 50 in accordance with the surface configuration of the support member cutting edge selected. At the end of the clockwise rotation of the shaft 58, the cutting mechanism will be in its home position as shown in FIG. 2 preparatory for a subsequent cutting operation.

While the principle of the invention has now been made clear in an illustrated embodiment, it will be obvious to those skilled in the art that many modifications of structure, arrangement, elements, and components can be made which are particularly adapted for specific environments and operating requirements without departing from these principles. The appended claims are therefore intended to cover any such modification within the limits of the true spirit and scope of the invention.

What is claimed is:

1. An apparatus for cutting a record member comprising:

a. a first rotatable support member having a plurality of cutting edge configurations located thereon;

b. a second rotatable support member having a cutting edge located thereon;

c. first means operatively associated with said first support member for rotating the support member a predetermined distance to position one of said cutting edge configurations adjacent said second support member;

d. and second means for rotating said second support member whereby the cutting edge of said second support member cooperates with the selected cutting edge configuration of said first support member to cut a record member in accordance with the configuration of the selected cutting edge.

2. The apparatus of claim 1 in which said first rotating means includes remotely operated control means for controlling the extent of rotation of said first support member to position a selected one of said cutting edge configurations in operable alignment with the cutting edge of said second rotatable support member.

3. The apparatus of claim 2 in which said first rotating means includes interconnecting means secured to said second rotating means and engaging said first rotating means to operate said first rotating means upon operation of said second rotating means.

4. The apparatus of claim 1 in which one of said cutting edge configurations include a plurality of recessed portions selectively spaced along said edge for perforating said record member when coacting with the cutting edge of said second support member.

5. The apparatus of claim 1 in which one of said cutting edge configurations has a recessed portion extending along its edge to partially sever the record member when coacting with the cutting edge of said second support member.

6. The apparatus of claim 3 in which said second rotating means includes a drive member operable through a predetermined distance for rotating said second support member a like distance, said interconnecting means comprises a cam member secured to said drive member and engaging said first rotating means to rotate said first rotating means in a first and second direction, said control means being operated during rotation of said first rotating means in said first direction to control the length of rotation of the first rotating means in said second direction whereby the first support member is moved to position a cutting edge configuration thereof adjacent said second support member in accordance with the extent of rotation of said first rotating means in said second direction.

7. In a data terminal device constructed and arranged to perform recording operations on a record member, a mechanism for selectively cutting the record member in a plurality of cutting configurations comprising;

a. a first rotatably mounted elongated support member having a plurality of first cutting edges located thereon, said first cutting edges defining more than one cutting configuration;

b. a second rotatably mounted support member positioned adjacent and extending along said first support member, said second support member having a second cutting edge;

c. first means for selectively rotating said first support member a first predetermined distance to position one of said first cutting edges adjacent said second support member;

d. and second means for rotating said second support member through a second predetermined distance allowing the second cutting edge to cooperate with the selected first cutting edge of said first support member to cut the record member in accordance with the configuration of the selected cutting edge.

8. The cutting mechanism of claim 7 in which one of said first cutting edge configurations includes a plurality of recessed areas spaced along said edge for perforating said record member when coacting with said second cutting edge to cut the record member.

9. The cutting mechanism of claim 7 in which one of said first cutting edge configurations has a recessed portion extending transversely along its edge to partially sever the record member when coating with said second cutting edge to cut the record member.

10. The cutting mechanism of claim 7 in which said first rotating means includes:

a. drive means engaging said first support member for rotating said support member when actuated;

b. means operatively associated with said second rotating means for actuating said drive means in first and second opposite directions upon operation of said second rotating means;

c. and control means engaging said drive means and operated during actuation of said drive means in said first direction to control the length of movement of said drive means in said second direction whereby said drive means will rotate said first support member commensurate with the movement of the drive means in said second direction to position one of said first cutting edges adjacent said second support member.

11. The cutting mechanism of claim 10 in which said drive means includes:

a. a first gear member secured to said first support member;

b. a gear segment rotatably mounted adjacent said first support member and engaging said first gear member, said gear segment rotated in said first and second directions by operation of said actuating means to rotate said first support member;

c. first abutment means secured to said gear segment;

d. and said control means includes a moveable control member positioned in the path of movement of said abutment means for engagement thereby, said control member settable to a plurality of engaging positions wherein each position of the control member will limit the rotation of said gear segment in said second direction whereby said first support member is rotated a distance commensurate with the position of the control member located in the path of movement of said first abutment means.

12. The cutting mechanism of claim 11 in which said drive means further includes:

a. second abutment means secured to said gear segment;

b. means secured to said gear segment for normally urging said gear segment in said second direction;

c. and said actuating means includes a drive member operated by said second rotating means and engaging said second abutment means to rotate said gear segment in said first direction against the action of said urging means, said drive member releasing said second abutment means to the action of said urging means whereby said urging means will move said gear segment in said second direction to rotate said first support member to position one of said first cutting edges adjacent said second support member.

13. The cutting mechanism of claim 12 in which said control member has a plurality of control surfaces located thereon, said control member being settable during movement of said gear segment in said first direction to position one of said control surfaces in the path of movement of said first abutment means to limit the movement of the gear segment in said second direction whereby the first support member is rotated to position one of said first cutting edges adjacent said second support member in accordance with the control surface positioned in the path of movement of said first abutment means.

14. The cutting mechanism of claim 13 in which said drive means further includes a selectively operated positioning member engaging said control member to move said control member a predetermined distance to position one of said control surfaces in the path of movement of said first abutment means when operated.

15. The cutting mechanism of claim 14 in which said positioning member is a multi-position solenoid.

16. The cutting mechanism of claim 12 in which said second operating means includes a drive shaft operable to rotate said second support member through said second predetermined distance, said drive member secured to said drive shaft and operated thereby to rotate said gear segment in said first direction during the first portion of the operation of the said drive shaft.

17. In a data terminal device constructed and arranged to perform recording operations on a record member, a mechanism for selectively cutting the record member in a plurality of cutting configurations comprising:

a. a first elongated support member rotatably mounted adjacent the record member, such support member having a plurality of first cutting edges each having a different cutting configuration;

b. a second elongated support member rotatably mounted adjacent the record member and coactive with said first support member, said second support member having a second cutting edge;

c. drive means engaging said second support member for rotating said second support member wherein said second cutting edge cooperates with one of said first cutting edges to cut the record member in accordance with the configuration of said first cutting edge;

d. means for selectively positioning one of said first cutting edges adjacent said second support member including means operated by said drive means for conditioning said first support member for movement in a first direction to position one of said first cutting edges adjacent said second support member;

e. and control means operated during operation of said conditioning means to control the length of movement of said first support member in said first direction.

18. The cutting mechanism of claim 17 in which the said first cutting edges include an edge having a configuration comprised of a plurality of recessed areas spaced along said edge for perforating said record member when coacting with said second cutting edge.

19. The cutting mechanism of claim 17 in which said first cutting edges include an edge having a configuration comprising a recessed portion extending transversely along its edge to partially sever the record member when coacting with said second cutting edge.

20. The cutting mechanism of claim 17 in which said conditioning means includes:

a. a gear member secured to said first support member;

b. a gear segment rotatably mounted adjacent said first support member and engaging said gear member;

c. means engaging said gear segment for normally urging said gear segment in said first direction to position one of said first cutting edges adjacent said second support member;

d. and a drive member secured to said drive means and engaging said gear segment to rotate said gear segment in a second direction during a first portion of the operation of said drive means and to release the gear segment to the action of said urging means during the second portion of the operation of said drive means, said control means being operated during the first portion of the operation of said drive means to control the length of movement of the gear segment in said first direction to select one of the said first cutting edges for positioning adjacent said second cutting edge.

21. The cutting mechanism of claim 20 in which said gear segment includes a cam surface located thereon and said drive member comprises a cam member engaging said cam surface to rotate said gear segment in said second direction during the first portion of the operation of said drive means and to release the gear segment to the action of said urging means during the second portion of the operation of said drive means.

22. The cutting mechanism of claim 20 in which said conditioning means further includes a blocking member secured to said gear segment, said control means including a control member rotably mounted adjacent said gear segment and having a plurality of blocking surfaces located thereon, and an actuating member engaging said control member, said actuating member being selectively operated to move the control member a predetermined distance to position one of the blocking surfaces in the path of movement of said blocking member whereby upon movement of said gear segment in said first direction by said urging means, the selected blocking surface of said control member will engage said blocking member to position one of said first cutting edges adjacent said second support member.

23. The cutting mechanism of claim 22 in which said actuating member comprises a solenoid constructed to move the control member a plurality of predetermined distances to selectively position one of said blocking surfaces in the path of movement of said blocking member whereby the gear segment is rotated in said first direction a predetermined distance in accordance with the blocking surface of the control member position in the path of movement of said blocking member.

* * * * *